US011927182B2

(12) United States Patent
Kim

(10) Patent No.: US 11,927,182 B2
(45) Date of Patent: Mar. 12, 2024

(54) AIR COMPRESSING APPARATUS WITH DRY-AIR INTERNAL-EMISSION TRAP UNIT

(71) Applicant: TURBOWIN CO., LTD., Cheongju-si (KR)

(72) Inventor: Minsoo Kim, Daejeon (KR)

(73) Assignee: TURBOWIN CO., LTD., Cheongju-si (KR)

( * ) Notice: Subject to any disclaimer, the term of this patent is extended or adjusted under 35 U.S.C. 154(b) by 162 days.

(21) Appl. No.: 17/459,399

(22) Filed: Aug. 27, 2021

(65) Prior Publication Data

US 2023/0058866 A1 Feb. 23, 2023

(30) Foreign Application Priority Data

Aug. 20, 2021 (KR) ..... 10-2021-0110444

(51) Int. Cl.
*F04B 39/16* (2006.01)
*F04B 39/00* (2006.01)

(52) U.S. Cl.
CPC ..... *F04B 39/16* (2013.01); *F04B 39/0027* (2013.01)

(58) Field of Classification Search
CPC ..... F04B 39/16; F04B 53/001; F04B 39/12; F04B 39/0027
See application file for complete search history.

(56) References Cited

U.S. PATENT DOCUMENTS 4,505,128 A * 3/1985 Miller ..... B01D 5/0054 62/93
6,220,245 B1 * 4/2001 Takabayashi ..... A61M 16/0057 128/202.13
6,692,235 B2 * 2/2004 Kolodziej ..... F04D 29/5826 417/313

FOREIGN PATENT DOCUMENTS

| | | | |
|---|---|---|---|
| DE | 202009006578 | U1 | 7/2009 |
| JP | 2010281313 | A * | 12/2010 |
| JP | 2018062917 | A | 4/2018 |
| KR | 200192795 | Y1 | 8/2000 |
| KR | 101506227 | B1 | 3/2015 |
| KR | 1020180009649 | A | 1/2018 |
| KR | 101868914 | B1 | 6/2018 |
| KR | 101868915 | B1 | 6/2018 |

* cited by examiner

*Primary Examiner* — Nathan C Zollinger
(74) *Attorney, Agent, or Firm* — Rabin & Berdo, P.C.

(57) ABSTRACT

Disclosed is an air compressing apparatus with a dry-air internal-emission trap unit, and more specifically, to an air compressing apparatus with a dry-air internal-emission trap unit which solves various problems arising due to venting and improves an on-site environment where compressed air is used by guiding the venting to an inside of a system for compressing air rather than guiding the venting in the system for compressing air to the outside (atmosphere), and which maximizes energy efficiency and obtains a virtuous circle of energy by enabling compressed air that is discarded to be reused.

1 Claim, 8 Drawing Sheets

AIR COMPRESSING APPARATUS WITH DRY-AIR INTERNAL-EMISSION TRAP UNIT

BACKGROUND OF THE PRESENT INVENTION

Field of the Present Invention

The present invention relates to an air compressing apparatus with a dry-air internal-emission trap unit, and more specifically, to an air compressing apparatus with a dry-air internal-emission trap unit which solves various problems arising due to venting and improves an on-site environment where compressed air is used by guiding the venting to an inside of a system for compressing air rather than guiding the venting in the system for compressing air to the outside (atmosphere), and which maximizes energy efficiency and obtains a virtuous circle of energy by enabling compressed air that is discarded to be reused.

Description of the Related Art

Conventionally, in industrial sites of utilizing a compressed air, in addition to the compressed air required for the site, the remaining compressed air is discharged from the system for compressing air to the outside, thereby stabilizing the operation of the system for compressing air.

This is called a vent. The vent is defined as the release of air or gas into the atmosphere from a system that compresses the air when the internal pressure is exceeded.

Among them, an air vent is a device for automatically discharging air flowing into a pipe. If the vent is not performed in a system for compressing air, the air is filled in the pipe and excessive noise is generated. Also, it causes corrosion or increases the maintenance cost, due to the moisture contained in the compressed air. Moreover, it causes an air obstruction that interferes with the operation of devices such as a water filling device or a pump, which seriously affects the precision of a sensor of measuring the flow rate of air in a pipe and the operation of a control valve. In severe cases, serious problems such as paralysis of the entire facility can occur.

As described above, the air vent in the industrial site adopts a method of discharging the air to the atmosphere and causes many problems in the field, due to the generation of noise and condensate water and so on.

Accordingly, the present invention is to provide an air compressing apparatus capable of improving the working environment by allowing a vent to be formed in a system for compressing air.

In the meantime, as a prior art for an air compressing apparatus with a dry-air internal-emission trap unit, "A trap device for a moisture removal system of a vacuum pump" of Korean Patent Registration No. 10-1868915 (hereinafter referred to as "Patent Literature 1") is disclosed as shown in FIG. 7*a*.

Patent Literature 1 relates to a trap device for a moisture removal system of a vacuum pump, capable of effectively removing foreign matters and moisture, which are included in air sucked from an object to be evacuated to flow in the vacuum pump. According to the invention, the trap device is connected to the vacuum pump, which sucks the air from the object to be evacuated to form a negative pressure inside the object to be evacuated, to remove the foreign matters from the air sucked into the vacuum pump. The trap device comprises a housing having a plurality of compartments vertically formed therein; an inlet pipe inserted into the housing from the upper part of the housing to transfer the air flowing from the object to be evacuated to the compartment placed in the lowermost end of the housing among the compartments; and a trap oil filled in the compartment placed in the lowermost end. The air transferred into the compartment placed in the lowermost end of the housing through the inlet pipe moves to the upper part of the housing through the trap oil, and the compartment placed in the lowermost end of the housing is connected to the vacuum pump, thereby allowing the air to be sucked into the vacuum pump.

As another prior art for an air compressing apparatus to which the dry air internal discharge trap unit is applied, "A moisture removal system for a vacuum pump" of Korean Patent Registration No. 10-1868914 (hereinafter referred to as "Patent Literature 2") is disclosed as shown in FIG. 7*b*.

Patent Literature 2 relates to a moisture removal system for a vacuum pump, capable of effectively removing moisture, which is included in air sucked from an object to be evacuated to flow into a vacuum pump. According to the invention, the moisture removal system for a vacuum pump comprises the vacuum pump sucking air from an object to be evacuated to form a negative pressure inside the object to be evacuated; and a sub vacuum pump to suck the internal air of the vacuum pump. The moisture included in the air sucked from the object to be evacuated and flow into the vacuum pump is condensed inside the vacuum pump. When the pressure inside the vacuum pump is lowered by the sub vacuum pump, condensate generated by being condensed inside the vacuum pump is evaporated to be discharged to the outside of the vacuum pump by the sub vacuum pump.

As described above, Patent Literatures 1 and 2 are the same technical field as the present invention and have similar and identical technical concepts in terms of the basic elements of the present invention and the object of the present invention for removing moisture contained in the air flowing into the air suction device in comparison with the present invention. However, there is a difference in terms of the subject matters to be solved by the invention (object of the invention).

That is, there are differences in technical characteristics in specific solutions (components) of the invention for solving the problem to be solved by the invention and exerting the effect thereof.

Accordingly, the present invention is different from the conventional technology for removing moisture from the air including the Patent Literature 1 and Patent Literature 2. Also, the present invention seeks to achieve the technical features based on the problem to be solved by the invention (object of the invention), a solution means (element) for solving it, and the effect exerted by solving the same.

PATENT LITERATURE

Patent Literature 1: Korean Patent Registration No. 10-1868915 (Jun. 12, 2018)

Patent Literature 2: Korean Patent Registration No. 10-1868914 (Jun. 12, 2018)

SUMMARY OF THE PRESENT INVENTION

The present invention is made to solve the above-described problems in the related art, and an object thereof is to provide an air compressing apparatus that inhibits problems, that is, noise and condensate from being generated on a use site, due to venting so as to improve an on-site environment.

Another object of the present invention is to provide an air compressing apparatus that maximizes energy efficiency and obtains a virtuous circle of energy by processing (removing moisture from) compressed air which is discarded due to venting such that the compressed air can be re-used in an air compressing apparatus system.

According to an aspect of the present invention to achieve the object described above, there is provided an air compressing apparatus with a dry-air internal-emission trap unit, the air compressing apparatus including:

an air-compressing system housing that allows air to be suctioned, compressed, and discharged inside;

an air compressor that is positioned to be coupled to one side of an inside of the air-compressing system housing and suctions and compresses air which flows in from outside to generate compressed air; and a compressed-air internal/external discharger that is positioned to be coupled to one side of the inside of the air-compressing system housing, is connected and coupled to one side of the air compressor, and discharges compressed air generated by the air compressor to the outside, wherein the compressed-air internal/external discharger is configured to include:

a compressed-air discharging unit that discharges compressed air compressed by the air compressor to the outside; and a dry-air internal-emission trap unit that is coupled and connected to one side of the compressed-air discharging unit, divides compressed air generated from the air compressor and guides a part of divided compressed air to flow along a separate specific path so as to inhibit backflow of air generated in a process of emitting the compressed air through the compressed-air discharging unit, and causes flowing compressed air to be emitted to the inside of the air-compressing system housing, and wherein no compressed air is discarded to the outside other than compressed air which is needed on a use site by causing only the compressed air which is needed on the use site to be discharged from the air-compressing system housing such that noise and condensate due to compressed air which is emitted to the outside is inhibited from being generated.

At this time, the dry-air internal-emission trap unit is configured to include:

an internally-discharging compressed air flowing pipe module that is connected and coupled to one side of a lower part of the compressed-air discharging unit, causes compressed air compressed by the air compressor which is supplied to the compressed-air discharging unit to be divided, and causes divided compressed air to flow along a separate specific path; and an internally-discharging compressed air draining trap module that is formed to be coupled to a terminal end of the internally-discharging compressed air flowing pipe module, removes moisture from compressed air which flows through the internally-discharging compressed air flowing pipe module, and causes moisture-removed compressed air to be emitted as dry air to the inside of the air-compressing system housing, wherein backflow of air generated in the process of emitting the compressed air generated by the air compressor through the compressed-air discharging unit is inhibited, and moisture is removed from divided and discarded compressed air through the internally-discharging compressed air draining trap module such that the compressed air is caused to flow as dry air back into the air compressor, and wherein energy efficiency is maximized, and a virtuous circle of energy is obtained.

In the meantime, it should be understood that the terminology or the words used in claims should not be interpreted in normally or lexically sense. It should be interpreted as meaning and concept consistent with the technical idea of the present invention, based on the principle that the inventor can properly define the concept of the term in order to describe its invention in the best way.

Therefore, the embodiments described in the present specification and the configurations shown in the drawings are only the most preferred embodiments of the present invention, and not all the technical ideas of the present invention are described. Therefore, it is to be understood that various equivalents and modifications are possible.

BRIEF DESCRIPTION OF THE DRAWINGS

The above and other objects, features and advantages of the present invention will be more apparent from the following detailed description taken in conjunction with the accompanying drawings, in which.

REFERENCE SIGNS LIST

Figure 1:
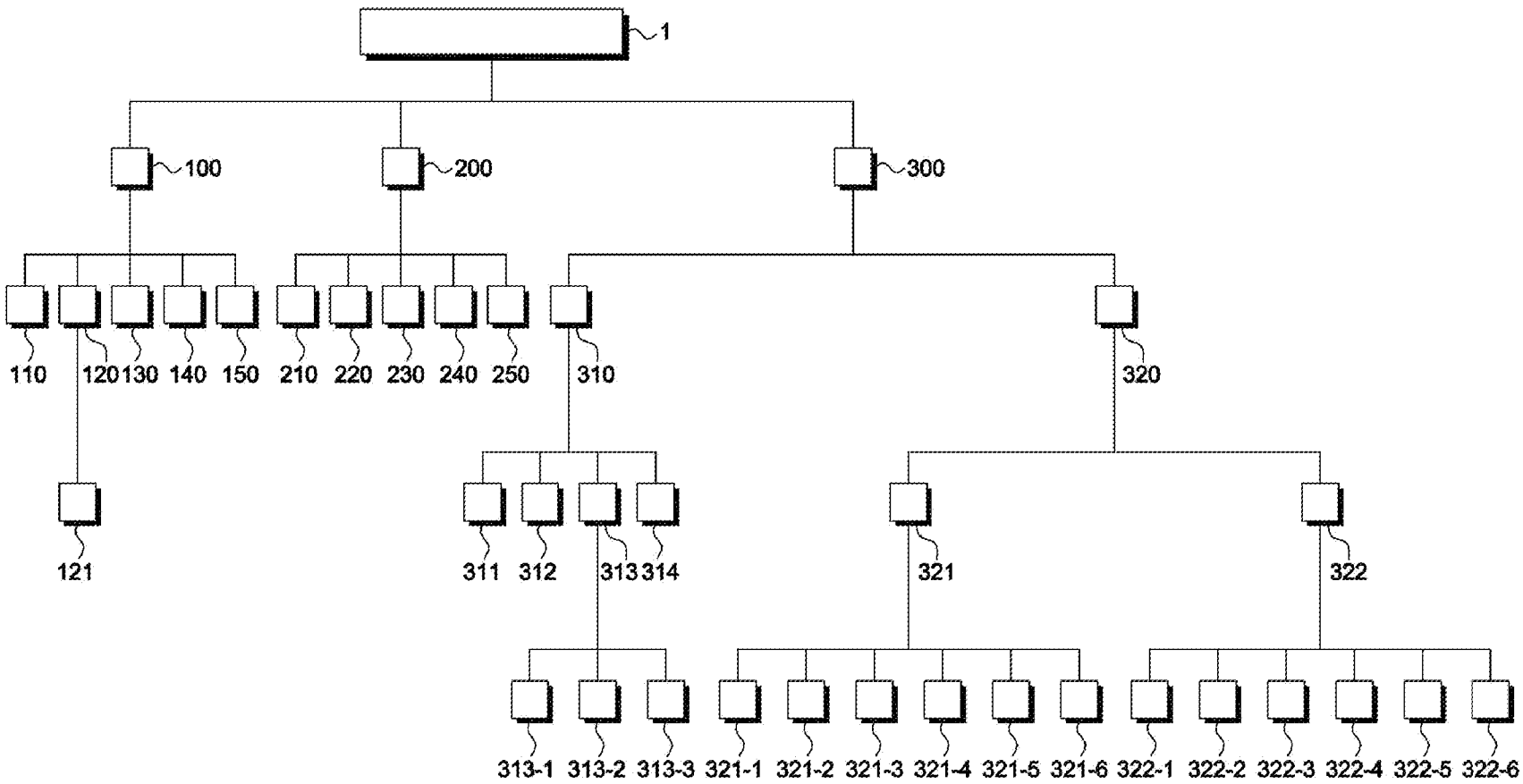
FIG. 1 is a diagram illustrating a configuration of an air compressing apparatus with a dry-air internal-emission trap unit according to the present invention.

1: air compressing apparatus with dry-air internal-emission trap unit
100: air-compressing system housing
110: air-compressing system housing unit
120: outside-air inflow unit
121: outside-air inflow filter module
130: compressed-air discharging unit
140: heat-exchanger fluid supply unit
150: air-compressing system control unit
200: air compressor
210: air compressing unit

220: air suction-filtering unit
230: plate-shaped heat exchanger unit
240: heat-transfer fluid flowing line unit
250: compressed-air moving line unit
300: compressed-air internal/external discharger
310: compressed-air discharging unit
311: compressed-air emitting pipe module
312: compressed-air emission check valve module
313: externally-discharging compressed air draining trap module
313-1: first drain-trap housing element
313-2: first drain-trap moisture falling-plate element
313-3: first moisture emitting line element
314: drained-moisture emitting line module
320: dry-air internal-emission trap unit
321: internally-discharging compressed air flowing pipe module
321-1: first internally-discharging compressed air flowing pipe element
321-2: second internally-discharging compressed air flowing pipe element
321-3: third internally-discharging compressed air flowing pipe element
321-4: first compressed-air pressure adjusting bleed-valve element
321-5: second compressed-air pressure adjusting bleed-valve element
321-6: third compressed-air pressure adjusting bleed-valve element
322: internally-discharging compressed air draining trap module
322-1: second drain-trap housing element
322-2: second drain-trap moisture falling-plate element
322-3: internally-emitting compressed air-noise reducing element
322-4: internally-emitting dry air filter element
322-5: second drain-trap housing fixing support element
322-6: second moisture emitting line element

DETAILED DESCRIPTION OF THE PREFERRED EMBODIMENT

Hereinafter, functions, configurations, and effects of an air compressing apparatus (1) with a dry-air internal-emission trap unit according to the present invention will be described in detail with reference to the accompanying drawings.

Figure 2:
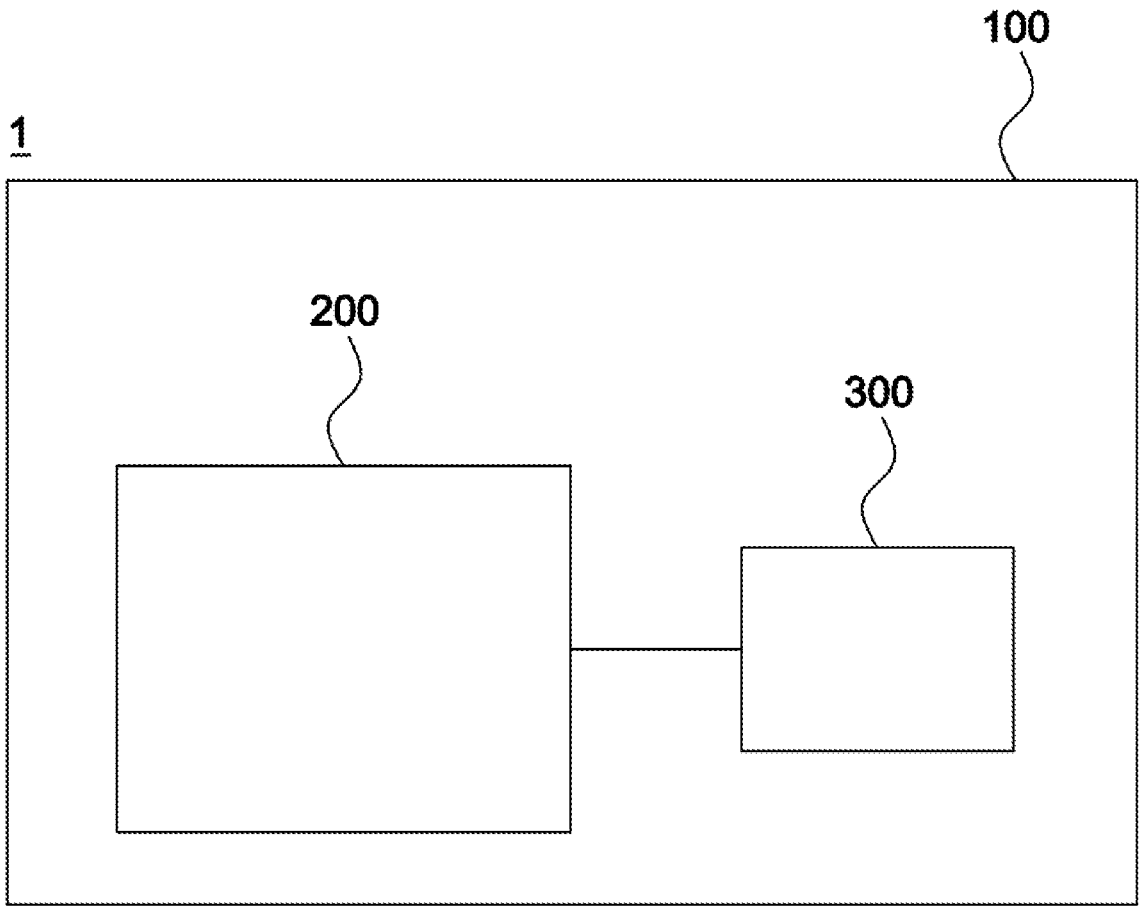
FIG. 2 is a conceptual diagram illustrating the air compressing apparatus with a dry-air internal-emission trap unit according to the present invention.
Figure 3:
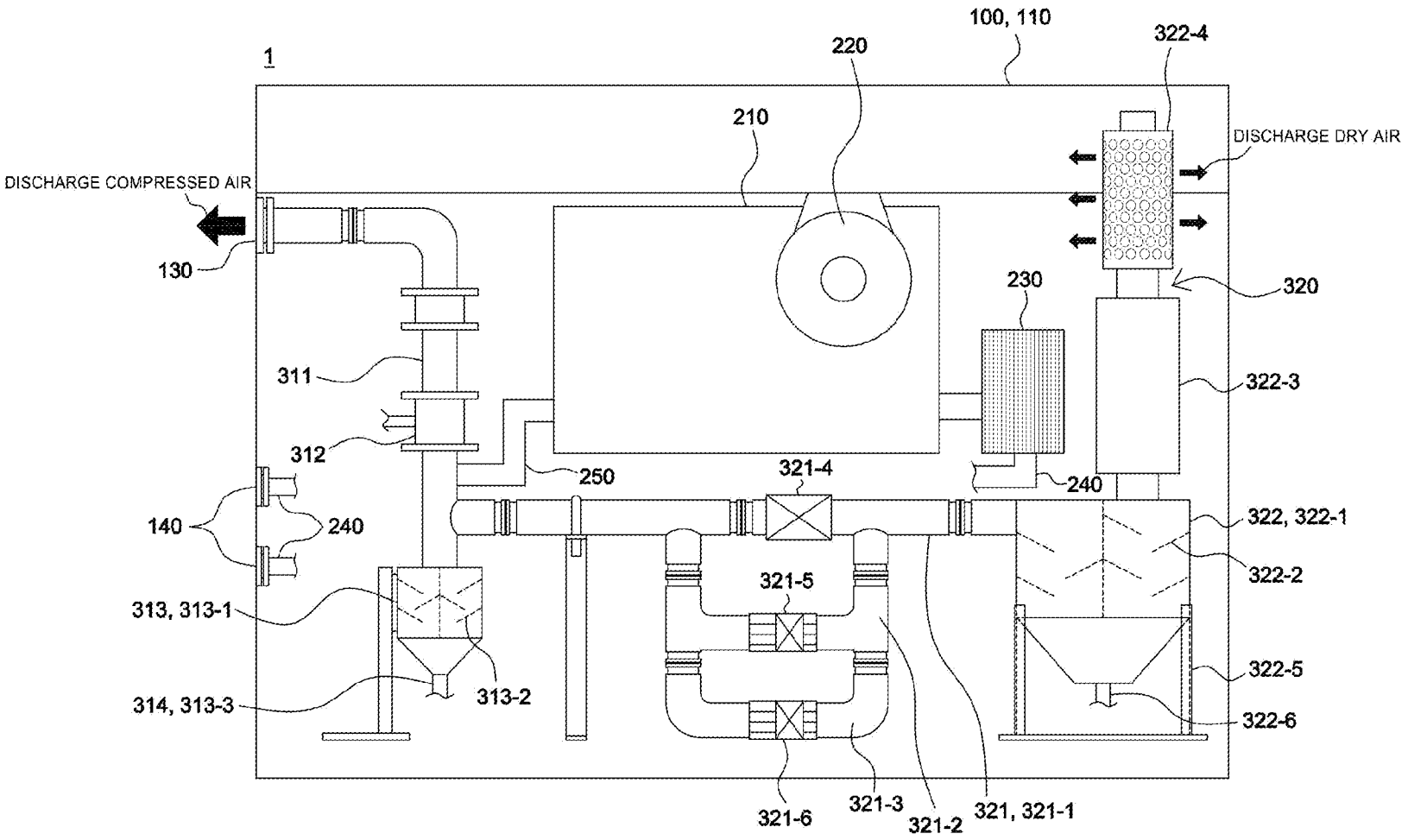
FIG. 3 illustrates an embodiment of the air compressing apparatus with a dry-air internal-emission trap unit according to the present invention.
Figure 4:
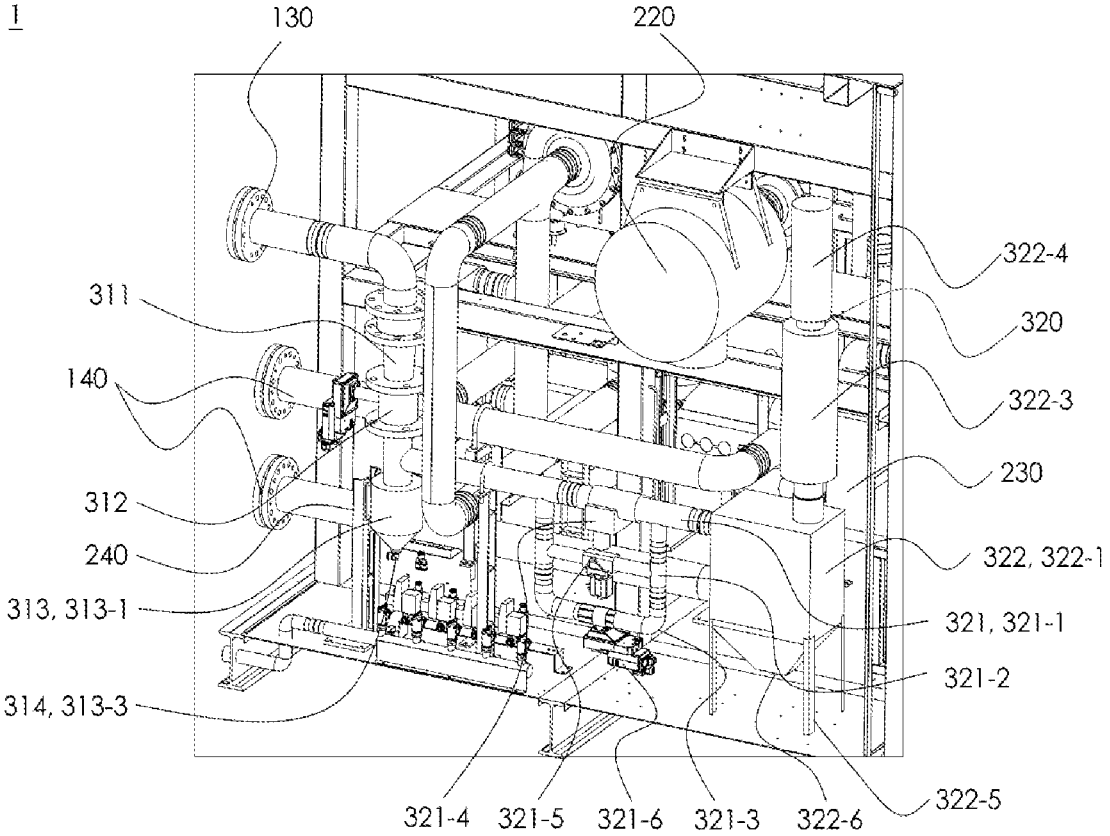
FIG. 4 is an actual picture illustrating a part of the embodiment of the air compressing apparatus with a dry-air internal-emission trap unit according to the present invention.
Figure 5:
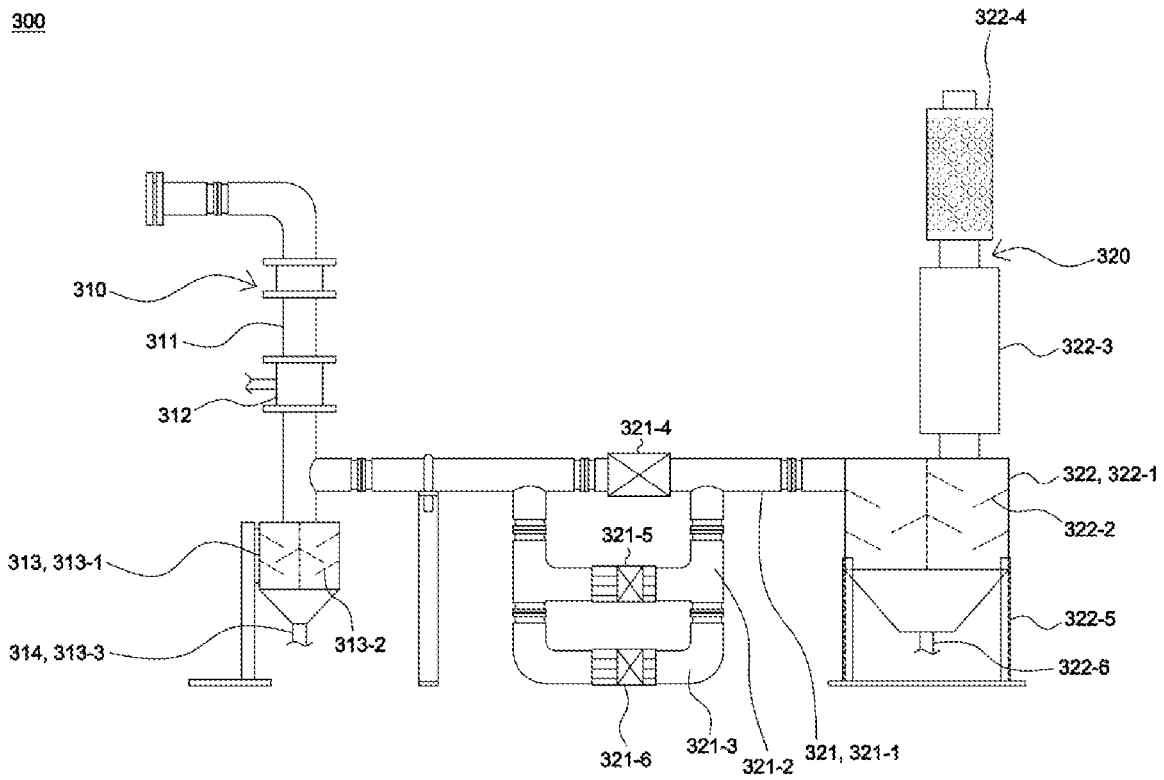
FIG. 5 is a schematic view illustrating a compressed-air internal/external discharger of configurational elements of the air compressing apparatus with a dry-air internal-emission trap unit according to the present invention.
Figure 6:
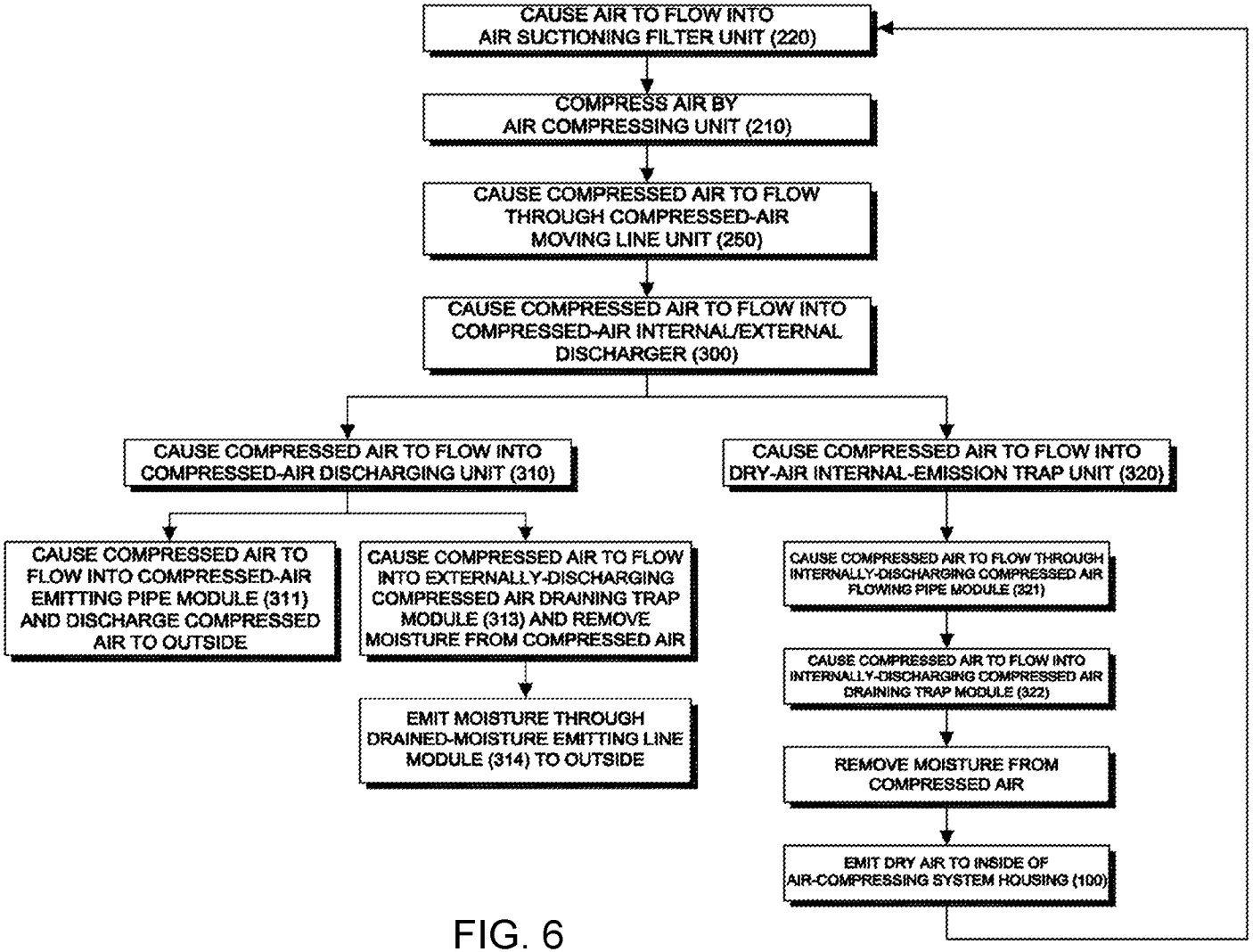
FIG. 6 is a flowchart schematically illustrating a mechanism of the compressed-air internal/external discharger of the configurational elements of the air compressing apparatus with a dry-air internal-emission trap unit according to the present invention.
Figure 7A:
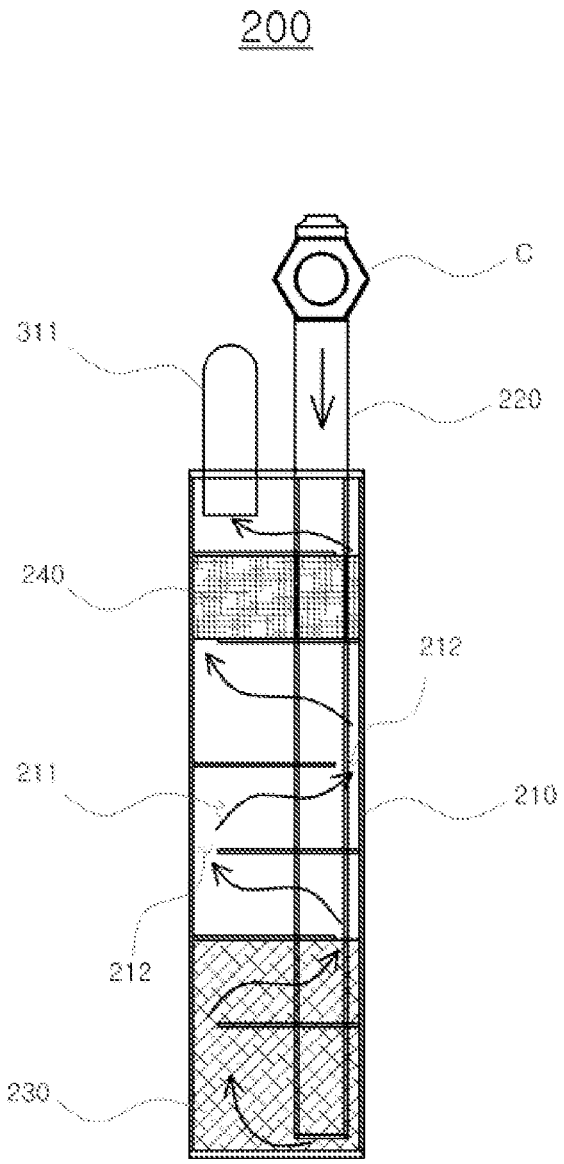
FIG. 7*a* is a representative view of the Patent Literature 1 for the air compressing apparatus with a dry-air internal-emission trap unit according to the present invention.
Figure 7B:
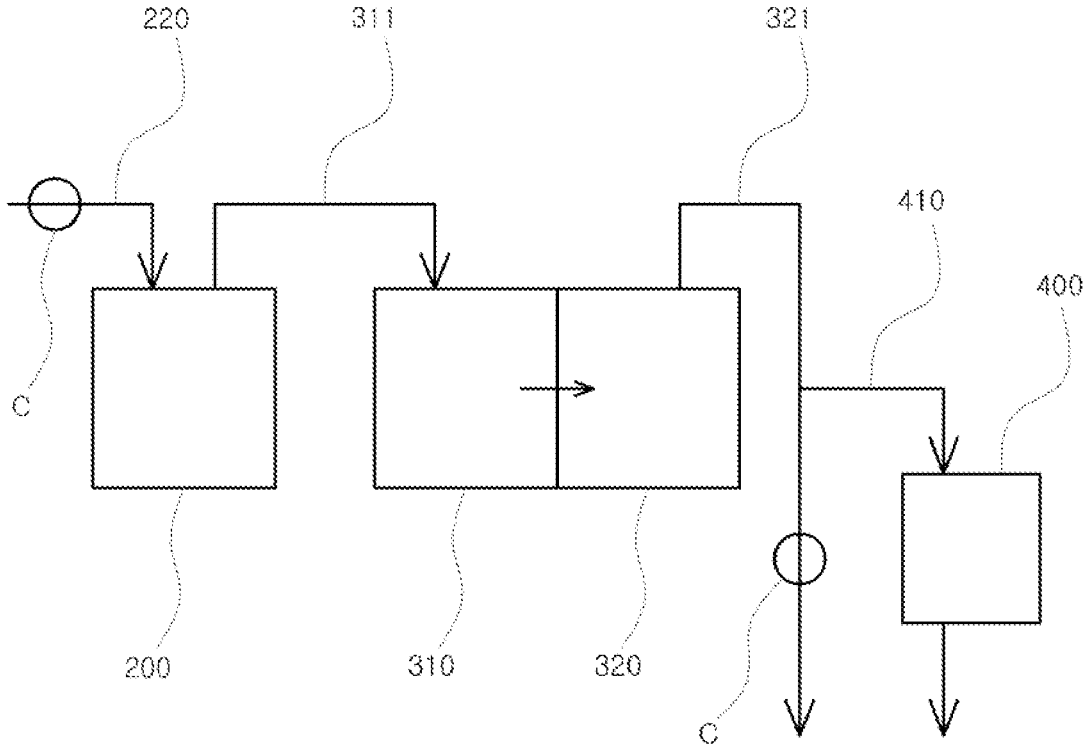
FIG. 7*b* is a representative view of the Patent Literature 2 for the air compressing apparatus with a dry-air internal-emission trap unit according to the present invention.

FIG. 1 is a diagram illustrating a configuration of an air compressing apparatus with a dry-air internal-emission trap unit according to the present invention. FIG. 2 is a conceptual diagram illustrating the air compressing apparatus with a dry-air internal-emission trap unit according to the present invention. FIG. 3 illustrates an embodiment of the air compressing apparatus with a dry-air internal-emission trap unit according to the present invention. FIG. 4 is an actual picture illustrating a part of the embodiment of the air compressing apparatus with a dry-air internal-emission trap unit according to the present invention. FIG. 5 is a schematic view illustrating a compressed-air internal/external discharger of configurational elements of the air compressing apparatus with a dry-air internal-emission trap unit according to the present invention. FIG. 6 is a flowchart schematically illustrating a mechanism of the compressed-air internal/external discharger of the configurational elements of the air compressing apparatus with a dry-air internal-emission trap unit according to the present invention.

As illustrated in FIGS. 1 to 6, according to the present invention, the air compressing apparatus (1) with a dry-air internal-emission trap unit includes:

an air-compressing system housing (100) that allows air to be suctioned, compressed, and discharged inside;

an air compressor (200) that is positioned to be coupled to one side of an inside of the air-compressing system housing (100) and suctions and compresses air which flows in from outside to generate compressed air; and a compressed-air internal/external discharger (300) that is positioned to be coupled to one side of the inside of the air-compressing system housing (100), is connected and coupled to one side of the air compressor (200), and discharges compressed air generated by the air compressor (200), to the outside.

The compressed-air internal/external discharger (300) is configured to include:

a compressed-air discharging unit (310) that discharges compressed air compressed by the air compressor (200) to the outside; and a dry-air internal-emission trap unit (320) that is coupled and connected to one side of the compressed-air discharging unit (310), divides compressed air generated from the air compressor (200) and guides a part of divided compressed air to flow along a separate specific path so as to inhibit backflow of air generated in a process of emitting the compressed air through the compressed-air discharging unit (310), and causes flowing compressed air to be emitted to the inside of the air-compressing system housing (100).

No compressed air is discarded to the outside other than compressed air which is needed on a use site by causing only the compressed air which is needed on the use site to be discharged from the air-compressing system housing (100) such that noise and condensate due to compressed air which is emitted to the outside is inhibited from being generated.

In other words, the present invention relates to an air compressing apparatus that inhibits noise and condensate due to emission of compressed air which is discarded to the outside (atmosphere) in the related art by guiding the compressed air which is emitted and discarded to the outside (atmosphere), other than the compressed air which is supplied to a portion which uses the compressed air in the air compressing system, to be emitted not to the outside (atmosphere) but to an inside of an air compressing system, and improves energy efficiency and obtains a virtuous circle of energy by guiding the compressed air which is discarded to re-flow, be suctioned, and be compressed in the air compressor (200) as the compressed air is emitted to the inside of the air compressing system such that optimum internal and external environments of the air compressing system are formed by removing moisture from the compressed air which is discarded and inhibiting problems (condensation) which can arise due to the compressed air which is discarded inside the air compressing system.

More specifically, the air-compressing system housing (100) is configured to include:

an air-compressing system housing unit (110) which is formed to have a certain space such that the air compressor (200) and the compressed-air internal/external discharger (300) are positioned inside the air-compressing system housing;

an outside-air inflow unit (120) which is formed into a specific shape to pass through at one side of the air-compressing system housing unit (110) and to which an outside-air inflow filter module (121) that allows air to flow from outside into the air-compressing system housing unit (110) is coupled;

a compressed-air discharging unit (130) that is formed to pass through at one side of the air-compressing system housing unit (110) and causes compressed air compressed by the air compressor (200) to be discharged to the outside through the compressed-air internal/external discharger (300);

a heat-exchanger fluid supply unit (140) that is formed to pass through at one side of the air-compressing system housing unit (110) and causes a fluid (antifreeze) to be supplied to a plate-shaped heat exchanger unit (230) which cools heat of compressed air, the heat rising in a process of discharging the compressed air compressed by the air compressor (200) to the outside through the compressed-air internal/external discharger (300); and an air-compressing system control unit (150) that is formed at one side of the air-compressing system housing unit (110) and controls operations of the air compressor (200) and the compressed-air internal/external discharger (300) which are positioned inside the air-compressing system housing unit (110) and controls discharge pressure and a flow rate of compressed air based on information acquired from various sensors. The apparatus that compresses air is to be formed of one system apparatus.

The air compressor (200) is configured to include:

an air compressing unit (210) that suctions and compresses air flowing from outside;

an air suction-filtering unit (220) that filters air suctioned into the air compressing unit (210);

the plate-shaped heat exchanger unit (230) that causes heat generated in compressed air to be transferred in a process of discharging compressed air compressed by the air compressing unit (210) to the outside;

a heat-transfer fluid flowing line unit (240) that has an end portion coupled to the heat-exchanger fluid supply unit (140) and the other end portion coupled to the plate-shaped heat exchanger unit (230) and causes the fluid (antifreeze) to flow and circulate to the plate-shaped heat exchanger unit (230) such that generated heat is transferred to the compressed air; and a compressed-air moving line unit (250) that has an end portion coupled to one side of the compressed-air internal/external discharger (300) and the other end portion coupled to the air compressing unit (210) and causes the compressed air compressed by the air compressing unit (210) to be discharged to the outside. In this manner, a suctioning and compressing process of air is smoothly performed.

The compressed-air internal/external discharger (300) is configured to include:

the compressed-air discharging unit (310) that discharges compressed air compressed by the air compressor (200) to the outside; and the dry-air internal-emission trap unit (320) that is coupled and connected to one side of the compressed-air discharging unit (310), divides compressed air generated from the air compressor (200) and guides a part of divided compressed air to flow along a separate specific path so as to inhibit backflow of air generated in a process of emitting compressed air through the compressed-air discharging unit (310), and causes flowing compressed air to be emitted to the inside of the air-compressing system housing (100).

No compressed air is discarded to the outside other than compressed air which is needed on a use site by causing only the compressed air which is needed on the use site to be discharged from the air-compressing system housing (100) such that noise and condensate due to compressed air which is emitted to the outside is inhibited from being generated.

In this case, the compressed-air discharging unit (310) is configured to include:

a compressed-air emitting pipe module (311) into which compressed air compressed by the air compressor (200) flows and which causes the compressed air to be emitted to the outside;

a compressed-air emission check valve module (312) which causes compressed air emitted from the compressed-air emitting pipe module (311) to flow and be emitted only in one direction;

an externally-discharging compressed air draining trap module (313) which is formed below the compressed-air emitting pipe module (311), removes moisture from compressed air that flows into the compressed-air emitting pipe module (311), and causes high-quality compressed air to be discharged through the compressed-air emitting pipe module (311) to the outside; and a drained-moisture emitting line module (314) that emits moisture filtered from the compressed air by the externally-discharging compressed air draining trap module (313) to the outside.

The compressed air compressed by the air compressor (200) is processed (moisture-removed) and is emitted to the outside.

The externally-discharging compressed air draining trap module (313) is configured to have:

a first drain-trap housing element (313-1) which has a lower portion formed into a cone shape and allows moisture separated from compressed air that flows into the compressed-air emitting pipe module (311) to fall downward;

a first drain-trap moisture falling-plate element (313-2) which is formed in a specific arrangement to have a certain downward slope inside the first drain-trap housing element (313-1) so as to come into contact with and have friction with the compressed air that flows in from the compressed-air emitting pipe module (311) and which removes moisture and causes the removed moisture to fall in the direction of gravity; and a first moisture emitting line element (313-3) which is formed to be coupled to a lower end portion of the first drain-trap housing element (313-1) and emits falling moisture to the outside.

In this manner, moisture is removed from the compressed air that flows in the compressed-air emitting pipe module (311).

The dry-air internal-emission trap unit (320) is configured to include:

an internally-discharging compressed air flowing pipe module (321) that is connected and coupled to one side of a lower part of the compressed-air discharging unit (310), causes compressed air compressed by the air compressor (200) which is supplied to the compressed-air discharging unit (310) to be divided, and causes divided compressed air to flow along a separate specific path; and an internally-discharging compressed air draining trap module (322) that is formed to be coupled to a terminal end of the internally-discharging compressed air flowing pipe module (321), removes moisture from compressed air which flows through the internally-discharging compressed air flowing pipe module (321), and causes moisture-removed compressed air to be emitted as dry air to the inside of the air-compressing system housing (100).

The backflow of air generated in the process of emitting compressed air generated by the air compressor (200) through the compressed-air discharging unit (310) is inhibited, and moisture is removed from divided and discarded compressed air through the internally-discharging compressed air draining trap module (322) such that the compressed air is caused to flow as dry air back into the air compressor (200).

Consequently, energy efficiency is maximized, and a virtuous circle of energy is obtained.

In this case, the internally-discharging compressed air flowing pipe module (321) is configured to have:

a first internally-discharging compressed air flowing pipe element (321-1) which causes a temporary pressure reduction of compressed air, inhibits the backflow of compressed air, and adjusts pressure of the discharged compressed air to optimal pressure by dividing a part of compressed air that flows to be discharged through the compressed-air discharging unit (310) to the outside;

a second internally-discharging compressed air flowing pipe element (321-2) which is formed below the first internally-discharging compressed air flowing pipe element (321-1) in parallel therewith and has the same function as the first internally-discharging compressed air flowing pipe element (321-1);

a third internally-discharging compressed air flowing pipe element (321-3) which is formed below the second internally-discharging compressed air flowing pipe element (321-2) in parallel therewith and has the same function as the first internally-discharging compressed air flowing pipe element (321-1);

a first compressed-air pressure adjusting bleed-valve element (321-4) which is formed to be coupled to one side of the first internally-discharging compressed air flowing pipe element (321-1) and enables flow of compressed air to be smoothly controlled;

a second compressed-air pressure adjusting bleed-valve element (321-5) which is formed to be coupled to one side of the second internally-discharging compressed air flowing pipe element (321-2) and enables flow of compressed air to be smoothly controlled; and a third compressed-air pressure adjusting bleed-valve element (321-6) which is formed to be coupled to one side of the third internally-discharging compressed air flowing pipe element (321-3) and enables flow of compressed air to be smoothly controlled.

The first compressed-air pressure adjusting bleed-valve element (321-4), the second compressed-air pressure adjusting bleed-valve element (321-5), and the third compressed-air pressure adjusting bleed-valve element (321-6) are appropriately opened and closed depending on pressure and the amount of the compressed air that flows into the compressed-air discharging unit (310), a load of the air compressor (200), or an unload state and enable the system that compresses and discharges air to stably operate and static pressure of the discharged compressed air to be smoothly controlled.

In addition, the internally-discharging compressed air draining trap module (322) is configured to have:

a second drain-trap housing element (322-1) which has a lower portion formed into a cone shape and allows moisture separated from compressed air that flows into the internally-discharging compressed air flowing pipe module (321) to fall downward;

a second drain-trap moisture falling-plate element (322-2) which is formed in a specific arrangement to have a certain downward slope inside the second drain-trap housing element (322-1) so as to come into contact with and have friction with the compressed air that flows therein from the internally-discharging compressed air flowing pipe module (321) and which removes moisture and causes the removed moisture to fall in the direction of gravity;

an internally-emitting compressed air-noise reducing element (322-3) which is formed to be coupled to a top portion of the second drain-trap housing element (322-1) and reduces noise due to the emitted compressed air;

an internally-emitting dry air filter element (322-4) which is formed to be coupled to a top portion of the internally-emitting compressed air-noise reducing element (322-3), lastly re-filters moisture and foreign substance from the emitted compressed air, and causes moisture-removed compressed air to be emitted to the inside of the air-compressing system housing unit (110);

a second drain-trap housing fixing support element (322-5) which fixes and positions the second drain-trap housing element (322-1) at one side of the inside of the air-compressing system housing unit (110); and a second moisture emitting line element (322-6) which is formed to be coupled to a lower end portion of the second drain-trap housing element (322-1) and emits falling moisture to the outside.

Moisture is removed from the compressed air that flows in the internally-discharging compressed air flowing pipe module 321, and the compressed air is emitted as the dry air to the inside of the air-compressing system housing unit 110.

Meanwhile, FIG. 6 is a flowchart schematically illustrating a mechanism of the compressed-air internal/external discharger of the configurational elements of the air compressing apparatus with a dry-air internal-emission trap unit according to the present invention.

More specifically, air in the outside of the air-compressing system housing (100) first flows to the inside of the air-compressing system housing (100).

The air flowing to the inside of the air-compressing system housing (100) is suctioned and compressed by the air compressor (200).

The compressed air compressed by the air compressor (200) is discharged through the compressed-air internal/external discharger (300) to the outside of the air-compressing system housing (100) (discharged as the compressed air which is needed on the use site) and at the same time, is emitted to the inside of the air-compressing system housing (100) (emitted as the dry air by processing discarded compressed air).

The problems of the noise and condensate due to the compressed air discarded to the outside of the air-compressing system housing (100) in the related art are solved.

In addition, the moisture-removed compressed air which is discarded to the inside of the air-compressing system housing (100) re-flows into the air compressor (200) and is re-compressed, and thereby an on-site work environment is improved. Further, energy efficiency is maximized, and the virtuous circle of energy is obtained.

In other words, air in the outside of the air-compressing system housing unit (110) flows to the inside of the air-compressing system housing unit (110) through the outside-air inflow unit (120).

The air flowing to the inside of the air-compressing system housing unit (110) is suctioned and compressed in the air compressing unit (210) through the air suction-filtering unit (220).

The compressed air compressed by the air compressing unit (210) flows through the compressed-air moving line unit (250) and is discharged and emitted to the outside and inside of the air-compressing system housing unit (110) through the compressed-air emitting pipe module (311) and the internally-discharging compressed air flowing pipe module (321), respectively.

The compressed air that flows in the compressed-air emitting pipe module (311) is subjected to moisture removal through the externally-discharging compressed air draining trap module (313), and the compressed air is discharged to the outside of the air-compressing system housing unit (110). The compressed air, which flows to the internally-discharging compressed air flowing pipe module (321) and is discarded, is subjected to the moisture removal through the internally-discharging compressed air draining trap module (322), and the moisture-removed compressed air is emitted to the inside of the air-compressing system housing unit (110).

Consequently, the problems (inhibition of noise or condensate) in the related art are to be solved.

As described above in the configurations and effects, the present invention is very effective as follows.

1. Various problems due to venting on a use site in the related art, that is, various safety accidents which can occur due to generation of noise and condensate, are inhibited in advance such that an on-site work environment can be improved.
2. Compressed air is vented to an inside of the air compressing apparatus system, and thereby compressed air which is discarded to the outside (atmosphere) can be significantly reduced.

In other words, energy efficiency can be maximized, and a virtuous circle of energy can be obtained.

3. The problems which can arise due to the venting to the inside of the air compressing apparatus system, that is, condensation and internal noise generated in the air compressing apparatus system, are solved in advance such that the venting can be performed to the inside of the air compressing apparatus system.

It will be apparent to those skilled in the art that various modifications and variations can be made in the present invention without departing from the spirit or scope of the present invention as defined in the appended claims.

This invention can be implemented in many different forms without departing from technical aspects or main features. Therefore, the implementation examples of this invention are nothing more than simple examples in all respects and will not be interpreted restrictively.

INDUSTRIAL APPLICABILITY

The present invention relates to an air compressing apparatus with a dry-air internal-emission trap unit, it can be applied to a manufacturing and sales business of manufacturing them, and it can contribute to an improvement in various industrial fields such as eco-friendly energy industries to promote an environmental improvement, an energy efficiency, and a virtuous cycle of energy in industrial sites that require compressed air.

What is claimed is:

1. An air compressing apparatus with a dry-air internal-emission trap unit, the air compressing apparatus comprising:

an air-compressing system housing that allows air to be suctioned, compressed, and discharged inside;

an air compressor that is positioned to be coupled to an inside of the air-compressing system housing and suctions and compresses air which flows in from outside to generate compressed air; and a compressed-air internal/external discharger that is positioned to be coupled to the inside of the air-compressing system housing, is connected and coupled to the air compressor, and discharges compressed air generated by the air compressor to the outside, wherein the compressed-air internal/external discharger is configured to include:

a compressed-air discharging unit that discharges compressed air compressed by the air compressor to the outside; and a dry-air internal-emission trap unit that is coupled and connected to the compressed-air discharging unit, divides compressed air generated from the air compressor and guides a part of divided compressed air to flow along a separate specific path so as to inhibit backflow of air generated in a process of emitting the compressed air through the compressed-air discharging unit, and causes flowing compressed air to be emitted to the inside of the air-compressing system housing, wherein no compressed air is discarded to the outside other than compressed air which is needed on a use site by causing only the compressed air which is needed on the use site to be discharged from the air-compressing system housing such that noise and condensate due to compressed air which is emitted to the outside is inhibited from being generated, wherein the dry-air internal-emission trap unit is configured to include:

an internally-discharging compressed air flowing pipe module that is connected and coupled to a lower part of the compressed-air discharging unit, causes compressed air compressed by the air compressor which is supplied to the compressed-air discharging unit to be divided, and causes divided compressed air to flow along the separate specific path; and an internally-discharging compressed air draining trap module that is formed to be coupled to a terminal end of the internally-discharging compressed air flowing pipe module, removes moisture from compressed air which flows through the internally-discharging compressed air flowing pipe module, and causes moisture-removed compressed air to be emitted as dry air to the inside of the air-compressing system housing, and wherein backflow of air generated in the process of emitting the compressed air generated by the air compressor through the compressed-air discharging unit is inhibited, and moisture is removed from divided and discarded compressed air through the internally-discharging compressed air draining trap module such that the compressed air is caused to flow as dry air back into the air compressor.

* * * * *